US009674595B2

(12) United States Patent
Ara et al.

(10) Patent No.: US 9,674,595 B2
(45) Date of Patent: Jun. 6, 2017

(54) SPEAKER AND MANUFACTURING METHOD THEREOF

(71) Applicant: Panasonic Intellectual Property Management Co., Ltd., Osaka (JP)

(72) Inventors: Masamichi Ara, Miyagi (JP); Kenichi Ajiki, Mie (JP); Toshinori Yamaji, Okayama (JP); Keiji Ishikawa, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/778,576

(22) PCT Filed: Mar. 12, 2014

(86) PCT No.: PCT/JP2014/001398
§ 371 (c)(1),
(2) Date: Sep. 18, 2015

(87) PCT Pub. No.: WO2014/156017
PCT Pub. Date: Oct. 2, 2014

(65) Prior Publication Data

US 2016/0142803 A1 May 19, 2016

(30) Foreign Application Priority Data

Mar. 27, 2013 (JP) ..... 2013-065862

(51) Int. Cl.
*H04R 9/00* (2006.01)
*H04R 1/06* (2006.01)
(Continued)

(52) U.S. Cl.
CPC ..... *H04R 1/06* (2013.01); *H04R 7/18* (2013.01); *H04R 9/025* (2013.01); *H04R 9/045* (2013.01);
(Continued)

(58) Field of Classification Search
CPC .... H04R 9/00; H04R 29/003; H04R 2209/00; H04R 2209/41
(Continued)

(56) References Cited

U.S. PATENT DOCUMENTS 3,609,652 A * 9/1971 Sebastian ..... H01R 4/50 381/409
5,583,944 A 12/1996 Morohoshi et al.
(Continued)

FOREIGN PATENT DOCUMENTS

JP 3-027198 U 3/1991
JP 6-209497 7/1994
(Continued)

OTHER PUBLICATIONS

International Search Report of PCT application No. PCT/JP2014/001398 dated Jun. 10, 2014.

*Primary Examiner* — Suhan Ni
(74) *Attorney, Agent, or Firm* — McDermott Will & Emery LLP

(57) ABSTRACT

A loudspeaker includes a frame, a magnetic circuit, a magnetic gap, a diaphragm, a voice coil, a connector portion, and a lead wire. The connector portion is provided at the frame, and includes a terminal. The lead wire connects between the terminal and the voice coil, and has a connection portion connected to the terminal. Then, a first holder that holds the lead wire is formed at the connector portion. The lead wire is held between the terminal and the first holder as being clamped.

14 Claims, 10 Drawing Sheets

(51) Int. Cl.

| | |
|---|---|
| ***H04R 31/00*** | (2006.01) |
| ***H04R 9/06*** | (2006.01) |
| ***H04R 7/18*** | (2006.01) |
| ***H04R 9/02*** | (2006.01) |
| ***H04R 9/04*** | (2006.01) |

(52) U.S. Cl.
CPC ..... *H04R 9/06* (2013.01); *H04R 31/00* (2013.01); *H04R 31/006* (2013.01)

(58) Field of Classification Search
USPC ..... 381/396, 409, 433
See application file for complete search history.

(56) References Cited

U.S. PATENT DOCUMENTS

| | | | | |
|---|---|---|---|---|
| 6,922,477 | B1 * | 7/2005 | Ikeyama ..... | H04R 1/025 381/409 |
| 8,073,184 | B2 * | 12/2011 | Horigome ..... | H04R 1/06 381/409 |
| 8,155,374 | B2 * | 4/2012 | Yuasa ..... | H04R 1/06 381/409 |
| 2002/0054691 | A1 | 5/2002 | Miyamoto et al. | |

FOREIGN PATENT DOCUMENTS

| | | |
|---|---|---|
| JP | 9-130890 | 5/1997 |
| JP | 2002-152882 | 5/2002 |
| JP | 2003-319492 | 11/2003 |

* cited by examiner

SPEAKER AND MANUFACTURING METHOD THEREOF

TECHNICAL FIELD

The present invention relates to a loudspeaker including a connector portion, and a method for manufacturing the loudspeaker.

BACKGROUND ART

In the following, a description will be given of a conventional loudspeaker. The conventional loudspeaker includes a frame, a magnetic circuit unit, a diaphragm, a voice coil, and lead wires.

The magnetic circuit is coupled at a central part of the frame. On the other hand, the diaphragm is coupled to an outer circumference of the frame. A voice coil is bonded at a central part of the diaphragm. The magnetic circuit includes a magnetic gap, into which the voice coil is inserted.

Further, the frame is provided with a connector portion. The connector portion is provided with terminals, and electrical connection to an external device is established via the terminals. Lead wires connect the terminals and the voice coil. The lead wires are fixed to the terminals by soldering.

Known conventional art literature information relating to the invention of the present application may be, for example, PTL 1.

CITATION LIST

Patent Literature

PTL 1: Unexamined Japanese Patent Publication No. H9-130890

SUMMARY OF THE INVENTION

A loudspeaker of the present invention includes a frame, a magnetic circuit, a magnetic gap, a diaphragm, a voice coil, a connector portion, and lead wires. The connector portion is provided at the frame, and includes terminals. The magnetic circuit is provided at a center of the frame. The diaphragm is coupled to an outer circumference of the frame. The voice coil is fixed to a central part of the diaphragm. The voice coil is inserted into a magnetic gap provided in the magnetic circuit. The lead wires have connection portions soldered to the terminals, and connect the terminals and the voice coil to each other.

A first holder holding the lead wires is formed at the connector portion, and the lead wire is held and clamped between the terminal and the first holder.

DESCRIPTION OF THE PREFERRED EMBODIMENT

Prior to the explanation of an exemplary embodiment of the present invention, the problem of conventional loudspeakers will be described. With a conventional loudspeaker such as disclosed in PTL 1, the positions where the lead wires are connected to the terminals are not determined. Accordingly, the position of the lead wire soldered to the terminal varies. The length of the lead wire from the voice coil to the terminal is not constant, and the route of the lead wire varies. As a result, noise is produced when the lead wire hits the diaphragm.

In the following, various types of loudspeakers according to the exemplary embodiment that address the above problem will be described with reference to the drawings. Among the loudspeakers, identical reference marks are allotted to identical structures, and a detailed description will not be repeated.

Figure 1:
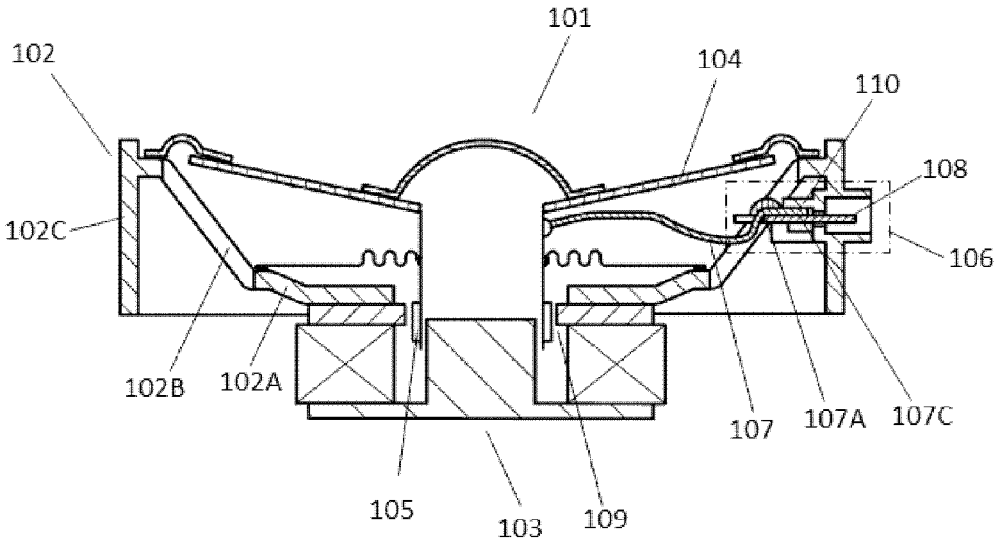
FIG. 1 is a cross-sectional view of a loudspeaker according to an exemplary embodiment of the present invention.
Figure 2:
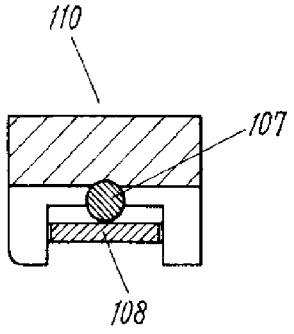
FIG. 2 is a substantial part cross-sectional view of a state where a terminal of the loudspeaker shown in FIG. 1 is fixed to a first holder, as seen from the inside of a frame.

FIG. 1 is a cross-sectional view of loudspeaker 101 according to the present exemplary embodiment. FIG. 2 is a substantial part cross-sectional view of a state where terminal 108 of loudspeaker 101 is fixed to first holder 110, as seen from the inside of frame 102.

Loudspeaker 101 includes frame 102, magnetic circuit 103, diaphragm 104, voice coil 105, connector portion 106, and lead wires 107. Magnetic circuit 103 is provided at the central part of frame 102. Diaphragm 104 is coupled to the outer circumference of frame 102, and voice coil 105 is fixed at a central part of diaphragm 104. Voice coil 105 is inserted into magnetic gap 109 provided in magnetic circuit 103. Connector portion 106 is provided at frame 102 near the outer circumference of frame 102, and includes terminals 108. Lead wire 107 connects terminal 108 and voice coil 105. Lead wire 107 includes connection portion 107A connected to terminal 108. Further, first holder 110 holding lead wire 107 is formed at connector portion 106.

Further, clamping portion 107C is formed at lead wire 107. Clamping portion 107C is clamped between terminal 108 and first holder 110. Clamping portion 107C is provided at lead wire 107 nearer to the tip side than connection portion 107A. Clamping portion 107C may be formed at lead wire 107 nearer to voice coil 105 side than connection portion 107A.

As described above, lead wire 107 is held and clamped between terminal 108 and first holder 110. Connection portion 107A is provided in close proximity to clamping portion 107C. Accordingly, variations in the position where connection portion 107A is soldered to terminal 108 are suppressed. Therefore, the positional variations in the route of lead wire 107 from voice coil 105 to terminal 108 can be suppressed. As a result, it becomes possible to suppress noise produced by lead wire 107 hitting diaphragm 104.

Since lead wire 107 can be easily arranged at a predetermined position in terminal 108, connection work between lead wire 107 and terminal 108 can be easily performed. Accordingly, a number of work steps in connecting lead wire 107 and terminal 108 can be reduced. That is, since connection portion 107A is arranged at a predetermined position in terminal 108, the work of connecting between terminal 108 and lead wire is not necessarily performed manually, and can be mechanized and easily automated. Accordingly, the costs required for the connection work can be reduced.

Figure 3:
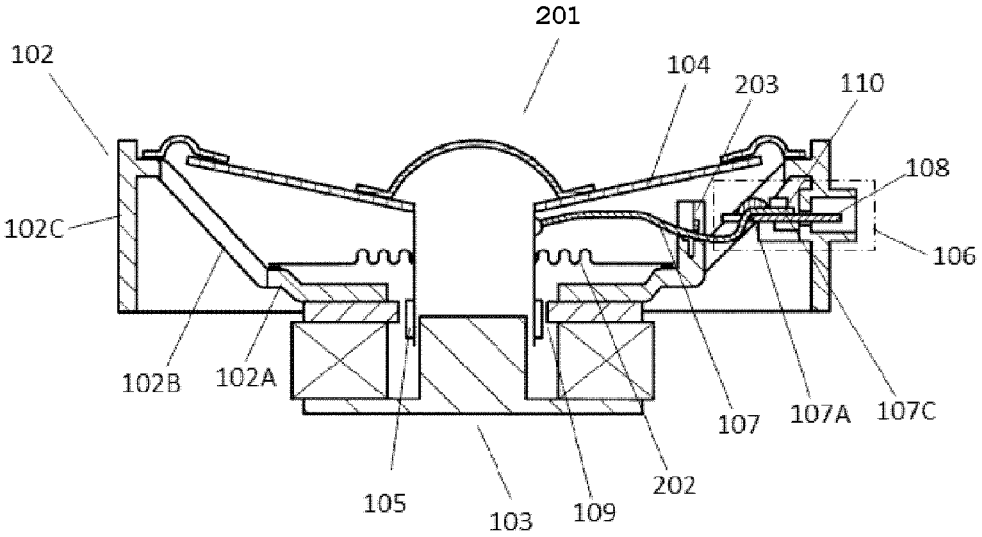
FIG. 3 is a cross-sectional view of other loudspeaker according to the exemplary embodiment of the present invention.
Figure 4:
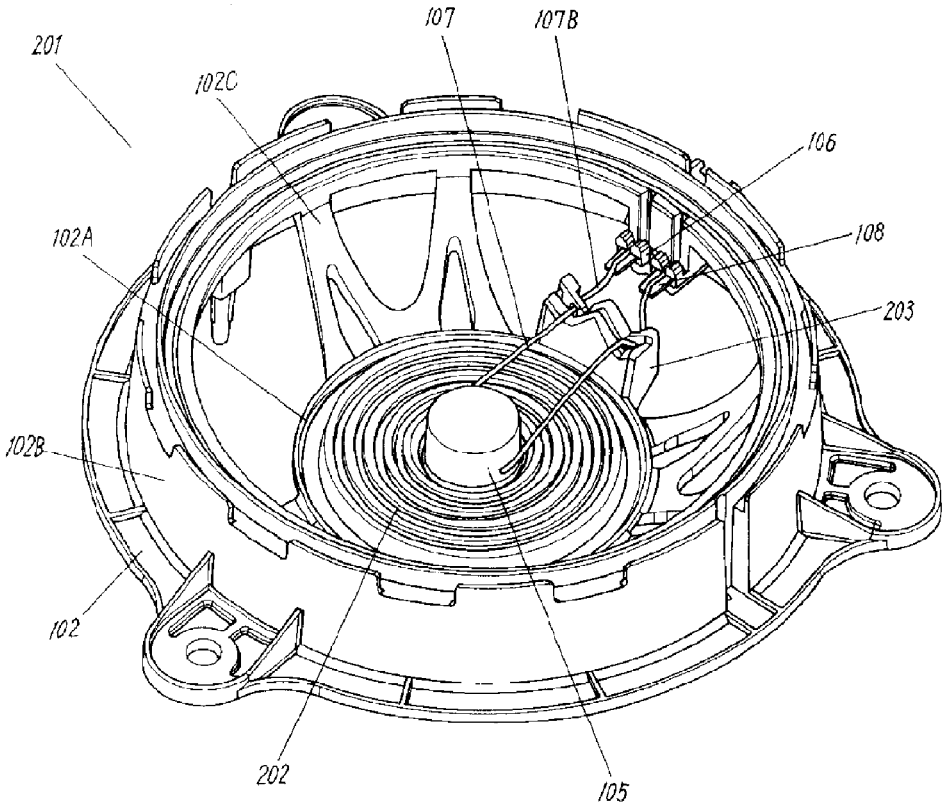
FIG. 4 is a perspective view of the loudspeaker shown in FIG. 3 in a state where a diaphragm is removed.

Next, a detailed description will be given of other loudspeaker 201 according to the present exemplary embodiment. FIG. 3 is a cross-sectional view of loudspeaker 201. FIG. 4 is a perspective view of loudspeaker 201 in a state where a diaphragm is removed. Similarly to loudspeaker 101, loudspeaker 201 includes frame 102 made of resin, magnetic circuit 103, diaphragm 104, voice coil 105, connector portion 106, and lead wires 107. Loudspeaker 201 further includes second holder 203.

In the following, descriptions of the constituent elements except second holder 203 hold true also for loudspeaker 101.

Lead wire 107 connects voice coil 105 and connector portion 106. Preferably, a tinsel wire is used as lead wire 107. Tinsel wire lead 107 includes a core line, and a conductor portion provided at the outer circumference of the core line. Generally, yarn is used as the core line. For example, a cotton yarn is preferably used as the core line. The conductor portion is made up of a plurality of twisted conducting wires. For example, a copper wire is preferably used as the conducting wire. That is, since the tinsel wire is formed by yarn whose cross section is approximately circular and which is wrapped around by the conducting wire, the cross-sectional shape of the tinsel wire is approximately circular. Further, it is preferable that loudspeaker 201 further includes damper 202.

Figure 5:
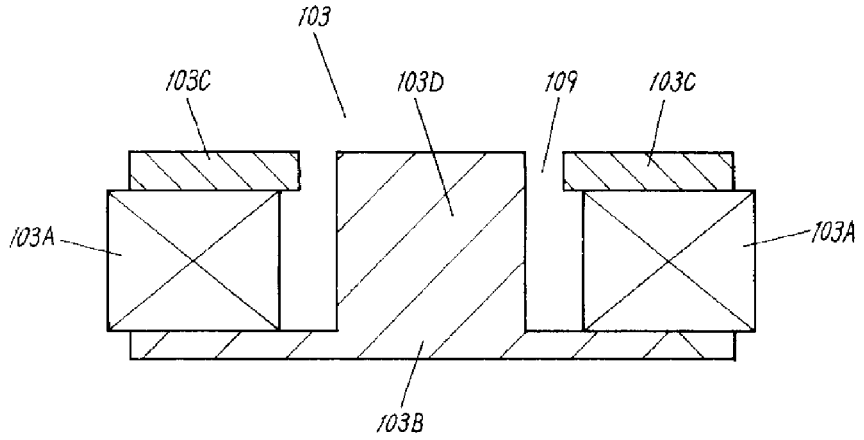
FIG. 5 is a cross-sectional view of a magnetic circuit of the loudspeaker according to the exemplary embodiment of the present invention as seen from the lateral direction.

Next, a description will be given of magnetic circuit 103 and magnetic gap 109 with reference to FIG. 5. FIG. 5 shows a cross-sectional view of magnetic circuit 103 as seen from the lateral direction. Magnetic circuit 103 may be an outer magnet type. Magnetic circuit 103 includes magnet 103A, lower plate 103B, and upper plate 103C. In magnetic circuit 103, ring-shaped magnet 103A is mounted on lower plate 103B, and ring-shaped upper plate 103C is mounted on magnet 103A. At the central part of lower plate 103B, projecting center pole 103D is formed. Lower plate 103B is arranged such that center pole 103D penetrates through a hole of magnet 103A. In the outer magnet type magnetic circuit 103 having such a structure, magnetic gap 109 is formed between a side surface of center pole 103D and a side surface of upper plate 103C.

Though the magnetic circuit herein is outer magnet type, the magnetic circuit is not limited thereto. For example, an inner magnet type magnetic circuit of, or a combination of the outer magnet type and the inner magnet type may be used.

Figure 6:
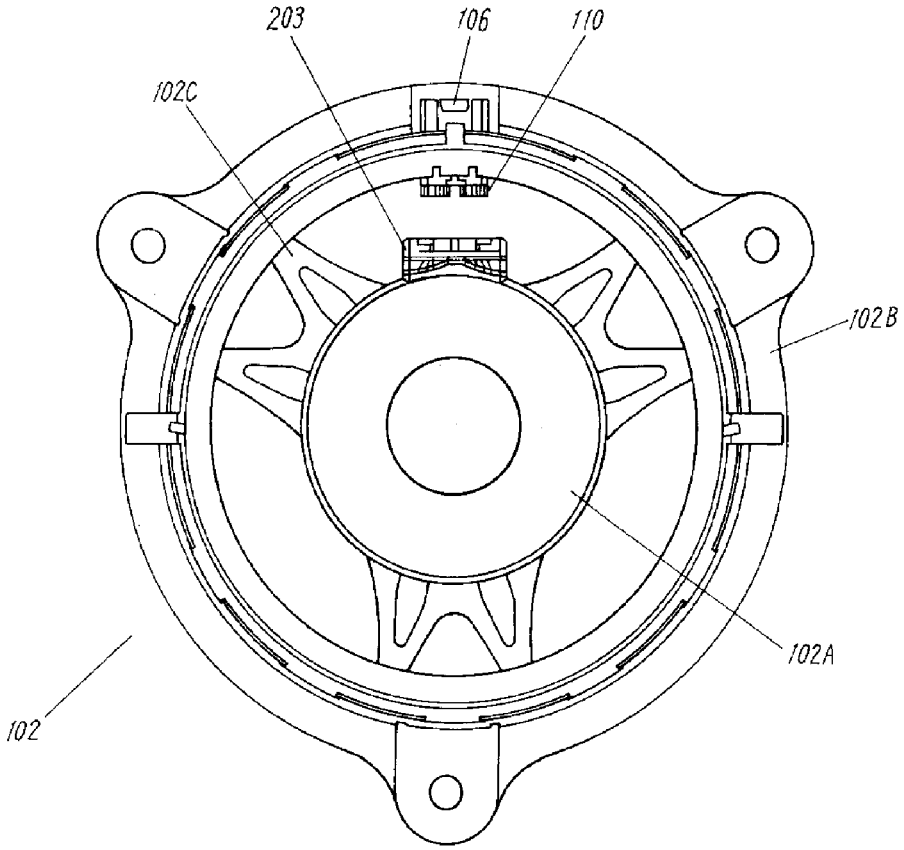
FIG. 6 is a top view of the frame of the loudspeaker shown in FIG. 3.
Figure 7:
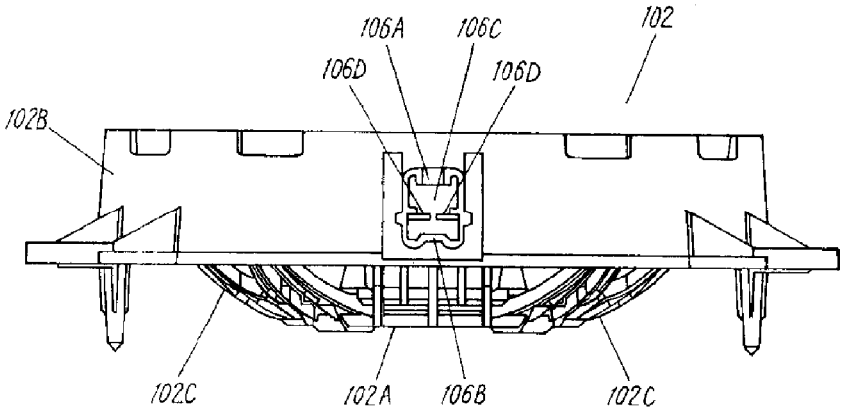
FIG. 7 is a side view of the frame shown in FIG. 6, as seen from the outside of the connector portion.

FIG. 6 shows a top view of frame 102 in loudspeaker 201. FIG. 7 shows a side view of frame 102 as seen from the outside of connector portion 106. Frame 102 includes magnetic circuit attaching portion 102A, outer frame portion 102B, coupling portion 102C, and second holder 203. Magnetic circuit attaching portion 102A is provided at the central part of frame 102, and magnetic circuit 103 shown in FIG. 5 is fixed to magnetic circuit attaching portion 102A. Specifically, an upper surface of upper plate 103C of magnetic circuit 103 is fixed to a lower surface of magnetic circuit attaching portion 102A.

As shown in FIG. 3, voice coil 105 penetrates through a through hole provided at the central part of magnetic circuit attaching portion 102A shown in FIG. 6, and a tip of voice coil 105 is located in magnetic gap 109. As shown in FIGS. 3 and 4, in the structure in which loudspeaker 201 includes damper 202, the inner circumference of damper 202 is bonded to voice coil 105. On the other hand, the outer circumference of damper 202 is bonded to the outer circumference of magnetic circuit attaching portion 102A shown in FIG. 6.

Further, as shown in FIGS. 3 and 4, second holder 203 restricts the route of lead wire 107. To this end, second holder 203 should be provided at the outer circumference of magnetic circuit attaching portion 102A. The center of second holder 203 and the center of connector portion 106 are arranged so as to be aligned on a line, when viewed from an upper side of the frame 102.

Connector portion 106 is formed at outer frame portion 102B. Coupling portion 102C couples magnetic circuit attaching portion 102A and outer frame portion 102B. Further, the outer circumference of diaphragm 104 shown in FIG. 3 is bonded on the outer circumferential end of outer frame portion 102B.

Figure 8:
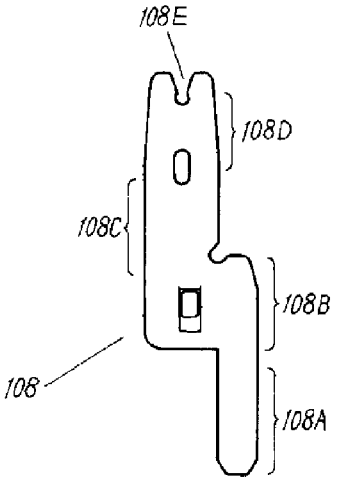
FIG. 8 is a top view of a terminal of the loudspeaker according to the exemplary embodiment of the present invention.
Figure 9A:
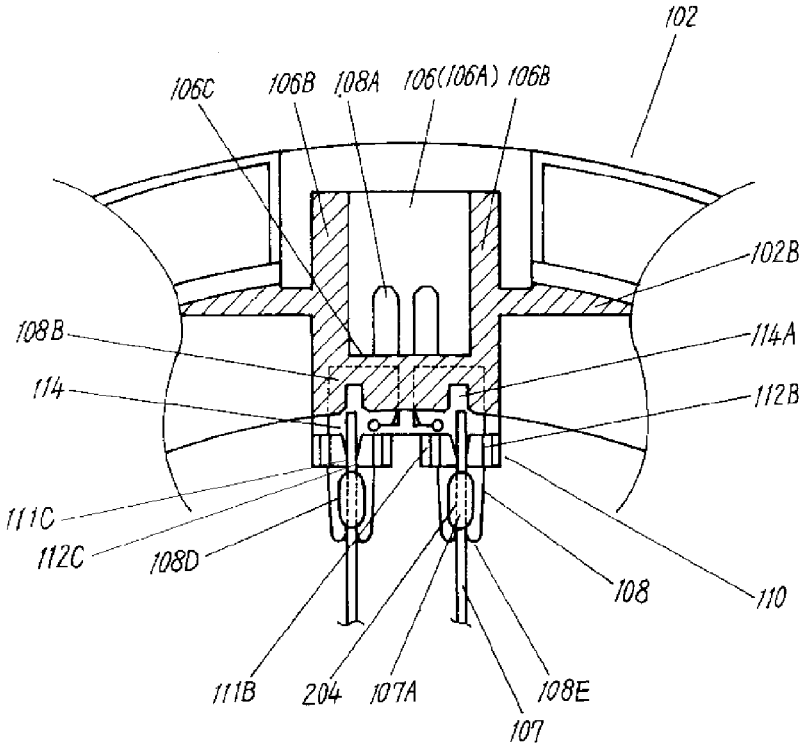
FIG. 9A is a substantial part cross-sectional view of a state where the terminal shown in FIG. 8 is fixed to the first holder, as seen from above.
Figure 9B:
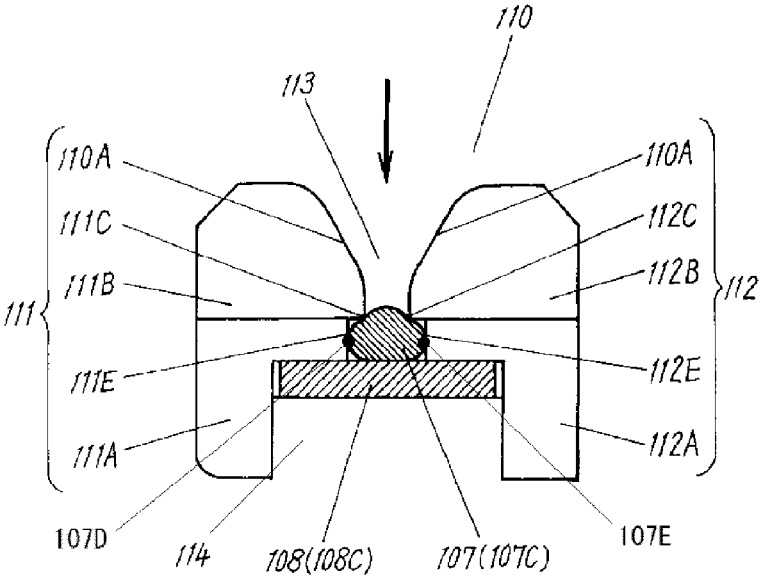
FIG. 9B is a substantial part cross-sectional view of a state where a lead wire is fixed to the first holder shown in FIG. 9A, as seen from inside of the frame.

Next, a description will be given of connector portion 106. FIG. 8 shows a top view of terminal 108. FIG. 9A shows a substantial part enlarged view of a state where terminal 108 is fixed to first holder 110, as seen from above. FIG. 9B is a substantial part cross-sectional view of a state where terminal 108 is fixed to first holder 110, as seen from the inside of frame 102. Connector portion 106 includes housing portion 106A made of resin, first holder 110 made of resin, and terminals 108 made of metal, as shown in FIG. 9A. Sidewall 106B of housing portion 106A protrudes from outer frame portion 102B in an outer direction of frame 102. Hole 106D shown in FIG. 7 is formed at bottom surface 106C of housing portion 106A. Housing portion 106A and first holder 110 are integrally formed with outer frame portion 102B.

Next, a description will be given of terminal 108. Terminal 108 is plate-shaped. As shown in FIG. 8, terminal 108 includes contact portion 108A, insert portion 108B, clamping portion 108C, connection portion 108D, and lead restriction portion 108E. Contact portion 108A is provided on one side of insert portion 108B. Clamping portion 108C, connection portion 108D, and lead restriction portion 108E extend, in terminal 108, in a direction opposite to contact portion 108A with insert portion 108B in between. Clamping portion 108C, connection portion 108D, and lead restriction portion 108E are arranged, from insert portion 108B toward a tip of terminal 108, in order of clamping portion 108C, connection portion 108D, and lead restriction portion 108E. Insert portion 108B is inserted into hole 106D shown in FIG. 7, and terminal 108 penetrates through bottom surface 106C.

Contact portion 108A projects from bottom surface 106C into housing portion 106A. On the other hand, clamping portion 108C, connection portion 108D, and lead restriction portion 108E project from the inner surface of outer frame portion 102B. The portion of lead wire 107 nearer to the tip side than connection portion 107A is held and clamped between first holder 110 and clamping portion 108C shown in FIG. 8. Further, lead wire 107 is positioned by lead restriction portion 108E. As shown in FIG. 9A, connection portion 108D and connection portion 107A are connected by connection member 204. Further, as shown in FIGS. 3 and 4, lead wires 107 connect terminals 108 and voice coil 105 via second holder 203.

By the constitution described above, lead wires 107 can be precisely attached to terminals 108. Further, since lead wires 107 are held by first holder 110 and lead restriction portion 108E, the portion of lead wire 107 between first holder 110 and lead restriction portion 108E is restricted by terminal 108. Accordingly, connection portion 107A can be suppressed from shifting upward from connection portion 108D. As a result, since the connection work between connection portion 108D and connection portion 107A can be easily performed, the connection work between connection portion 108D and connection portion 107A can be easily mechanized. Thus, the connection work between connection portion 108D and connection portion 107A can be automated.

Connection member 204 may be, for example, solder. Then, since the constitution described above makes it possible to suppress connection portion 107A from shifting upward from connection portion 108D, the amount of used solder for connecting connection portion 107A and connection portion 108D can be reduced. As a result, the amount of heat required for soldering becomes small. Accordingly, deformation of hole 106D by the heat of soldering can be suppressed, and wobbling of terminal 108 can also be suppressed.

As shown in FIG. 8, terminal 108 is provided with clamping portion 108C between insert portion 108B and connection portion 108D. Accordingly, by providing clamping portion 108C, the distance between connection portion 108D and bottom surface 106C becomes greater. That is, connection portion 107A is arranged so as to be away from hole 106D. As a result, deformation of hole 106D by heat of soldering can be suppressed. Accordingly, wobbling of terminal 108 can be suppressed.

It is preferable that clamping portion 108C is plate-shape, and as shown in FIG. 9B, a dimension of clamping portion 108C in a width direction is greater than a diameter of lead wire 107. By this constitution, lead wire 107 can be held and firmly clamped between first holder 110 and clamping portion 108C. Further, it is preferable that connection portion 108D is also plate-shape, and a dimension of connection portion 108D in the width direction is greater than the diameter of lead wire 107. As a result, the soldering work of lead wire 107 also becomes easy. Additionally, it is preferable that lead restriction portion 108E is also plate-like. By this constitution, lead restriction portion 108E can be easily formed at terminal 108. Accordingly, lead wire 107 can be positioned more precisely.

The shape of lead restriction portion 108E is a cutaway portion, for example. However, the shape of lead restriction portion 108E is not limited thereto. For example, lead restriction portion 108E may be a hole. Further, a bent portion may be formed at a tip of lead restriction portion 108E. Further, the shape of terminal 108 is not limited to a plate-shape. For example, contact portion 108A and insert portion 108B may be a pin-shape (linear).

Figure 10:
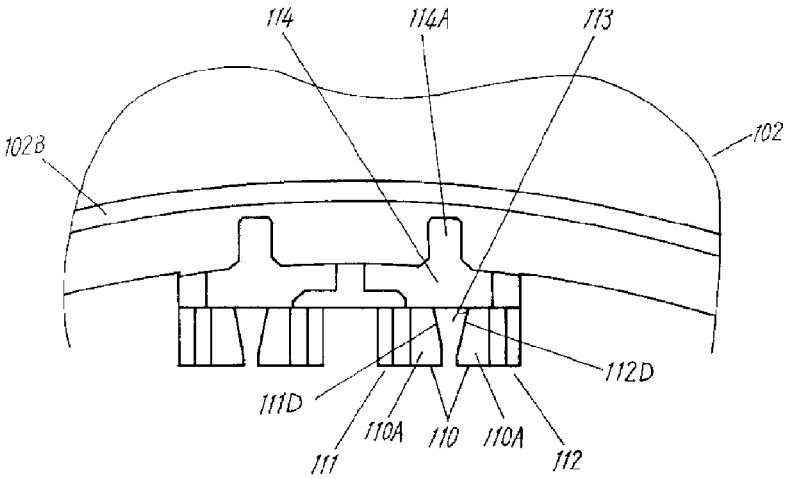
FIG. 10 is a substantial part enlarged view of the first holder shown in FIG. 9A, as seen from above.
Figure 11:
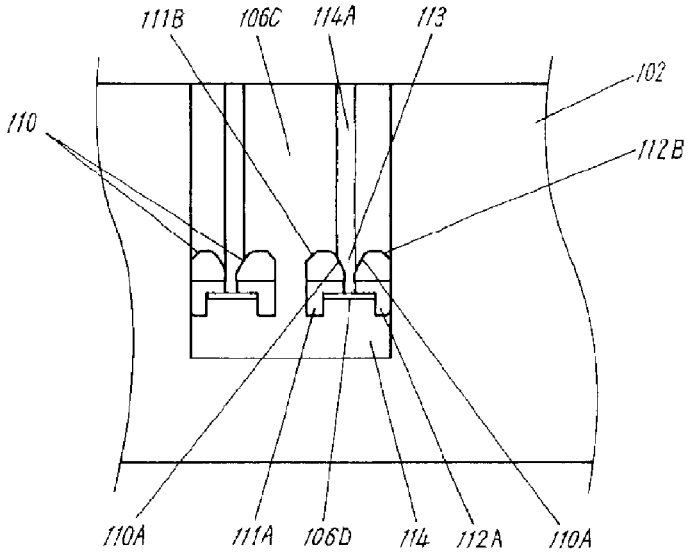
FIG. 11 is a substantial part enlarged view of the first holder shown in FIG. 9A, as seen from the inside of the frame.
Figure 12:
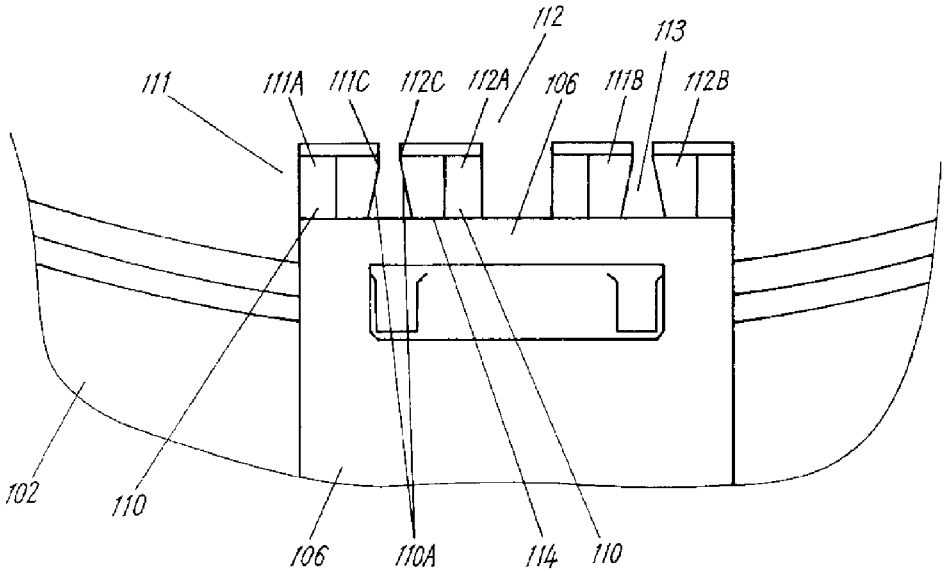
FIG. 12 is a substantial part enlarged view of the first holder shown in FIG. 9A as seen from below.

Lead wire 107 is held and clamped between terminal 108 and first holder 110. With reference to FIGS. 9B, 10 to 12, a description will be given of the constitution of first holder 110 and the constitution of temporary fixing of lead wire 107 to frame 102 using first holder 110. FIG. 10 is a substantial part enlarged view of first holder 110 as seen from above. FIG. 11 is a substantial part enlarged view of first holder 110 as seen from inside of frame 102. FIG. 12 is a substantial part enlarged view of first holder 110 as seen from below.

As shown in FIGS. 9B and 10, first holder 110 includes first holding claw 111, second holding claw 112, slit 113, and coupling portion 114. Further, first holding claw 111 includes first resilient portion 111A and first clamping portion 111B. On the other hand, second holding claw 112 includes second resilient portion 112A and second clamping portion 112B. As shown in FIG. 9B, first resilient portion 111A and second resilient portion 112A are both provided upright in the vertical direction relative to the surface of the drawing from coupling portion 114 (in FIG. 12, in the upper direction in the drawing). That is, first resilient portion 111A and second resilient portion 112A extend toward the center of frame 102.

As shown in FIG. 9B, at a tip of first resilient portion 111A, first clamping portion 111B is provided. At a tip of second resilient portion 112A, second clamping portion 112B is provided. First clamping portion 111B and second clamping portion 112B are not coupled to coupling portion 114. Slit 113 is formed between first holding claw 111 and second holding claw 112. First holding claw 111 and second holding claw 112 are arranged in parallel to each other with slit 113 between them.

As shown in FIG. 9B, it is preferable to use slit 113 as an insertion port for lead wire 107. In this case, when lead wire 107 is inserted, first resilient portion 111A and second resilient portion 112A elastically deform and slit 113 is widened. Accordingly, lead wire 107 can be easily inserted.

By the constitution described above, lead wire 107 is held and clamped by first clamping portion 111B, second clamping portion 112B, and clamping portion 108C, by virtue of the elastic force of first resilient portion 111A and second resilient portion 112A. Accordingly, lead wire 107 is precisely arranged on terminal 108, and hence variations in the position where lead wire 107 and terminal 108 are connected can be suppressed. Accordingly, variations in the position of the route of lead wire 107 from voice coil 105 to terminal 108 as shown in FIGS. 3 and 4 can be suppressed. As a result, noise produced by lead wire 107 hitting diaphragm 104 can be suppressed.

As shown in FIG. 9B, a clearance of slit 113 is set to be smaller than the diameter of lead wire 107. Further, a clearance between an upper surface of terminal 108 and a lower surface of first clamping portion 111B, and a clearance between the upper surface of terminal 108 and a lower surface of second clamping portion 112B are both set to be smaller than the diameter of lead wire 107. With such a constitution, lead wire 107 is clamped to terminal 108 by the elastic force of first holding claw 111 and second holding claw 112.

When a tinsel wire is used as lead wire 107, lead wire 107 is inserted while the conductor portion of the tinsel wire is compressed by the elastic force of first holding claw 111 or second holding claw 112. As a result, lead wire 107 is held in the state where the conductor portion is deformed by compression. Accordingly, it becomes possible to suppress lead wire 107 from dropping off from first holder 110.

Further, as shown in FIG. 9B, at one end of first holding claw 111 which is at a side surface of first holding claw 111 facing slit 113 and which is nearer to terminal 108, corner portion 111C is formed. On the other hand, at one end of second holding claw 112 which is at a side surface of second holding claw 112 facing slit 113 and which is nearer to terminal 108 also, corner portion 112C is formed. Accordingly, lead wire 107 is held and clamped by corner portion 111C, corner portion 112C, and clamping portion 108C.

By the constitution described above, a center axis of lead wire 107 can be easily and precisely arranged near the center of slit 113 or clamping portion 108C. Accordingly, the connection work between connection portion 107A and connection portion 108D becomes easy, and hence the steps required for the connection work can be reduced. Further, since the connection work can be easily automated, the costs required for the connection work can further be reduced.

Further, an abutting portion is formed at part of each of corner portion 111C and corner portion 112C. Corner portion 111C and corner portion 112C are in contact with lead wire 107 solely by the abutting portions. That is, first holding claw 111 and second holding claw 112 are in contact with lead wire 107 solely by the abutting portions, and first holding claw 111 and second holding claw 112 are not in contact with lead wire 107 by any other part. To this end, as shown in FIG. 10, first inclined surface 111D is formed on a side surface of first holding claw 111 facing slit 113 forms. Further, first inclined surface 112D is formed on a side surface of second holding claw 112 facing slit 113 in a direction to which lead wire 107 extends (see FIG. 9A).

For example, first inclined surface 111D and first inclined surface 112D are formed such that a width of the end of slit 113 (hereinafter referred to as the slit end) nearer to the voice coil 105 and a width of the slit end nearer to outer frame portion 102B are different when frame 102 is seen from above. By this constitution, lead wire 107 is clamped by corner portion 111C and corner portion 112C at the slit end with a smaller width, out of the slit end nearer to voice coil 105 shown in FIG. 3 (nearer to the center of frame 102) and the slit end nearer to outer frame portion 102B. Though first inclined surface 111D is formed on the side surface of first holding claw 111 facing slit 113, and first inclined surface 112D is formed on the side surface of second holding claw 112 facing slit 113, the present invention is not limited thereto. For example, only one of first inclined surface 111D and first inclined surface 112D may be formed.

Preferably, first inclined surface 111D or first inclined surface 112D is formed such that the width of the slit end being nearer to coupling portion 114 is greater than the width of the slit end being farther from coupling portion 114. By this constitution, first resilient portion 111A and second resilient portion 112A become easier to deform. Accordingly, even when the diameter of lead wire 107 varies, first resilient portion 111A and second resilient portion 112A can be suppressed from exceeding the limit of elastic deformation.

It is also possible that first inclined surface 111D or first inclined surface 112D is formed such that the width of the slit end nearer to the coupling portion 114 is smaller than the width of the slit end farther from coupling portion 114. In this case, since first resilient portion 111A and second resilient portion 112A withstand elastic deformation, the force of holding lead wire 107 can be increased.

Further, preferably, in first inclined surface 111D or first inclined surface 112D, the width of the slit end nearer to voice coil 105 is smaller than the width of the slit end farther from voice coil 105. By this constitution, even in the case where variations in the cutting dimension of lead wire 107 or variations in attachment of voice coil 105 are great, the distance from voice coil 105 to the abutting portion can be reduced. Accordingly, lead wire 107 can be easily held at a predetermined position.

Preferably, as shown in FIG. 9B, first holder 110 is provided with first guide portion 110A that guides lead wire 107 to a predetermined position. First guide portion 110A is formed by inclined surfaces provided at the side surface of first holding claw 111 facing slit 113, and the side surface of second holding claw 112 facing slit 113. These inclined surfaces are inclined in the direction toward which the width of the slit end on the opposite side to terminal 108 (on the upper side) becomes greater, as compared to the width of the slit end nearer to the terminal 108 (on the lower side), when first holder 110 is seen from the inside of frame 102. Accordingly, when lead wire 107 is inserted in the arrow direction, lead wire 107 is easily guided to a predetermined position by first guide portion 110A. Accordingly, insertion of lead wire 107 is easy. As a result, automation of the insertion work of lead wire 107 can be progressed by mechanization.

As described above, the cross-sectional shape of lead wire 107 is approximately circular. On the other hand, in the state where lead wire 107 is attached to first holder 110, the cross-sectional shape of lead wire 107 at clamping portion 107C is non-circular. In this case, regarding the dimension of the cross section of lead wire 107, the dimension in a direction in which first holding claw 111 and second holding claw 112 are arranged to be next to each other (a first direction) is preferably greater than the dimension in a direction perpendicular to the first direction (a second direction). By this constitution, lead wire 107 is further firmly held by first holder 110. Accordingly, it becomes possible to further suppress lead wire 107 from dropping off from first holder 110.

Further, as shown in FIG. 9B, abutting wall 111E is formed at first holding claw 111. On the other hand, abutting wall 112E is formed at second holding claw 112. In the state where lead wire 107 is attached to first holder 110, abutting wall 111E and abutting wall 112E abut on apex portions of lead wire 107 in the first direction in clamping portion 107C (which are referred to as first apex portion 107D and second apex portion 107E). First apex portion 107D and second apex portion 107E may abut only on one of abutting wall 111E and abutting wall 112E. By this constitution, since lead wire 107 is held and clamped against abutting wall 111E or abutting wall 112E, lead wire 107 can be further firmly held by first holder 110. Accordingly, it becomes possible to further suppress lead wire 107 from dropping off from first holder 110.

As shown in FIG. 9A, it is preferable to form recess portion 114A at coupling portion 114. Recess portion 114A houses the tip of lead wire 107 when lead wire 107 is excessively long. To this end, recess portion 114A is preferably arranged so as to overlap slit 113, as seen from the inside of frame 102. Further, recess portion 114A may be structured such that the tip of lead wire 107 is always inserted into recess portion 114A, irrespective of the length of lead wire 107. In this case, recess portion 114A functions as a restricting portion that restricts the position of the tip of lead wire 107.

Figure 13:
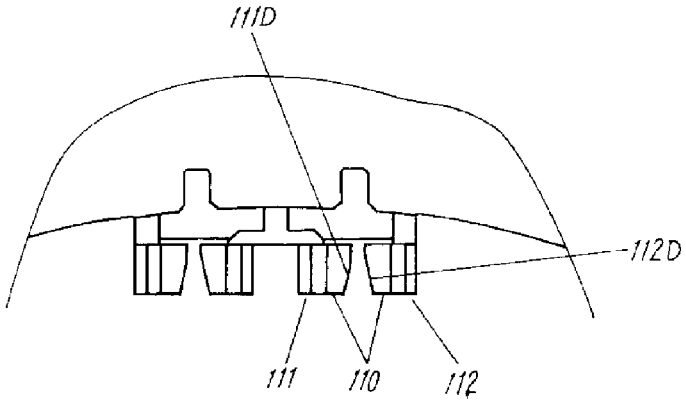
FIG. 13 is a substantial part enlarged view of another first holder according to the exemplary embodiment of the present invention as seen from above.

FIG. 13 is a substantial part enlarged view of the first holder of another loudspeaker according to the exemplary embodiment of the present invention. As shown, first inclined surface 111D or first inclined surface 112D may be formed such that the width of the slit end nearer to voice coil 105 is greater than the width of the slit end farther from voice coil 105. In this case, lead wire 107 shown in FIGS. 3 and 4 is held at the position nearer to the tip of lead wire 107. Then, by this constitution, the distance between lead restriction portion 108E and the abutting portions of first holding claw 111 and second holding claw 112 is increased. Accordingly, lead wire 107 can further be precisely arranged to terminal 108.

Figure 14:
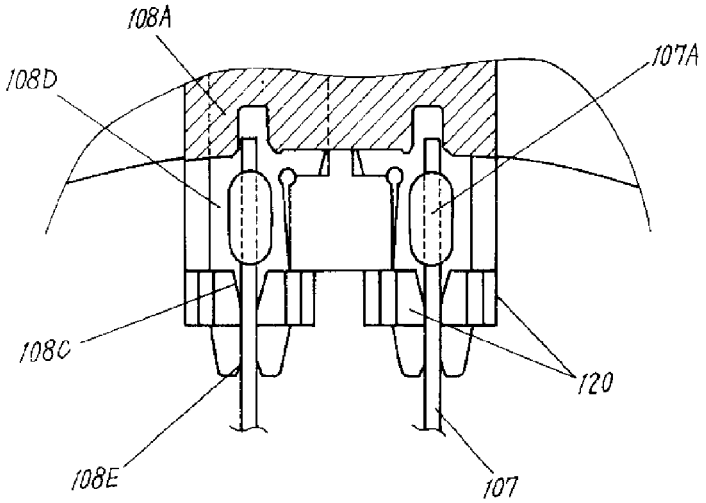
FIG. 14 is a substantial part cross-sectional view of a state where the terminal according to the exemplary embodiment of the present invention is fixed to another first holder.

FIG. 14 is a substantial part cross-sectional view of other loudspeaker according to the exemplary embodiment of the present invention as seen from above, in the state where the terminal is fixed to other first holder 120. In this case, lead wire 107 is held by first holder 120 at a position nearer to voice coil 105 shown in FIG. 3 than connection portion 107A. Accordingly, at terminal 108, connection portion 108D, clamping portion 108C, and lead restriction portion 108E are arranged in order of connection portion 108D, clamping portion 108C, and lead restriction portion 108E, from insert portion 108B. That is, lead wire 107 is connected to terminal 108 at a position nearer to the tip than the position held by first holder 120. Accordingly, between first holder 120 and the inner surface of frame 102 in bottom surface 106C, a distance by which lead wire 107 and terminal 108 can be connected is provided.

Next, a description will be given of second holder 203. As shown in FIGS. 3 and 4, second holder 203 is arranged between voice coil 105 and first holder 110. Second holder 203 holds lead wire 107 at a midway point in the wiring route of lead wire 107. Since lead wire 107 is held by second holder 203 at the intermediate point between voice coil 105 and first holder 110, variations in the wiring route of lead wire 107 can be further reduced. Accordingly, noise produced by lead wire 107 hitting diaphragm 104 can be suppressed. Further, lead wire 107 can be precisely arranged to terminal 108.

Lead wire 107 is provided with slack between voice coil 105 and second holder 203. This slack is provided not to prevent voice coil 105 vibration in the vertical direction. To this end, lead wire 107 is curved in a convex shape toward diaphragm 104 shown in FIG. 3, between voice coil 105 and second holder 203.

Further, in lead wire 107, adjuster 107B is preferably formed between second holder 203 and first holder 110. Adjuster 107B is provided for shaping lead wire 107 into a predetermined shape between voice coil 105 and second holder 203. At adjuster 107B, lead wire 107 is curved in the direction away from diaphragm 104 shown in FIG. 3. That is, by adjuster 107B being pushed downward, lead wire 107 is curved in the direction away from diaphragm 104 at adjuster 107B.

By the constitution described above, lead wire 107 positioned between voice coil 105 and second holder 203 can be easily shaped into a desired shape, and the extent of slack of lead wire 107 between voice coil 105 and second holder 203 can be easily adjusted. Accordingly, the route of lead wire 107 between voice coil 105 and second holder 203 can be restricted, and positional variations in the route can be easily reduced. As a result, it becomes possible to suppress occurrence of trouble that lead wire 107 hits diaphragm 104 or damper 202 when voice coil 105 vibrates. Accordingly, noise produced by lead wire 107 hitting diaphragm 104 or damper 202 can be suppressed.

Figure 15:
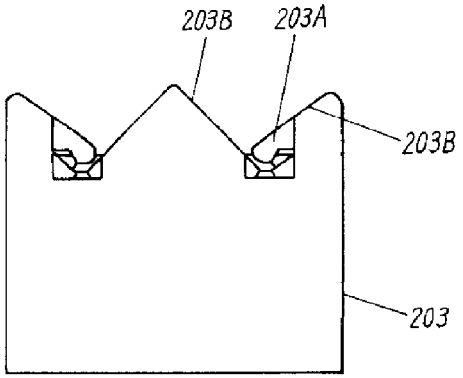
FIG. 15 is a side view of a second holder according to the exemplary embodiment of the present invention.
Figure 16:
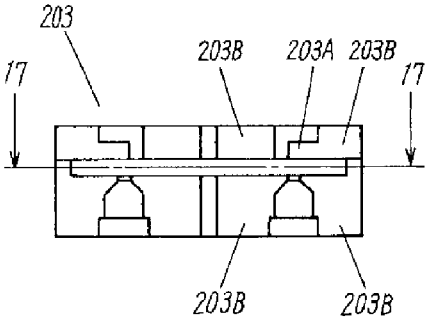
FIG. 16 is a top view of the second holder according to the exemplary embodiment of the present invention.
Figure 17:
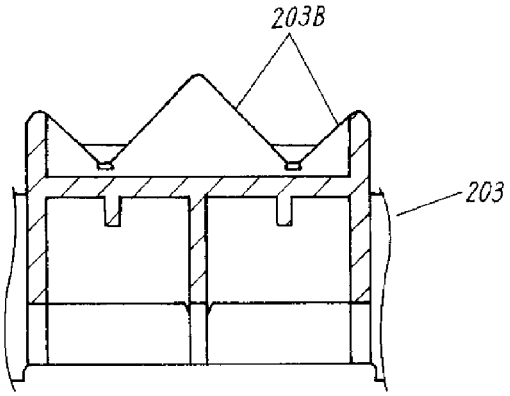
FIG. 17 is a cross-sectional view of the second holder according to the exemplary embodiment of the present invention.

FIG. 15 shows a side view of second holder 203. FIG. 16 shows a top view of second holder 203. FIG. 17 shows a cross-sectional view of second holder 203. FIG. 17 shows the cross section of second holder 203 taken along line 17-17 shown in FIG. 16. Second holder 203 includes restricting claw 203A and second guide portion 203B. Lead wire 107 is held at a predetermined position as being hooked by restricting claw 203A. In this manner, since lead wire 107 is hooked by restricting claw 203A, lead wire 107 can be prevented from dropping off from second holder 203. Second guide portion 203B guides lead wire 107 to a predetermined position. To this end, second guide portion 203B has valley-shape. That is, the width of second guide portion 203B is narrowed from the side into which lead wire 107 is inserted in second holder 203 toward restricting claw 203A. Accordingly, lead wire 107 can be easily arranged at a predetermined position.

Housing portion 106A is integrally molded with frame 102. Alternatively, for example, housing portion 106A may be fabricated separately from frame 102, and housing portion 106A may be fixed to frame 102. In this case, first holder 110 may be integrally formed with housing portion 106A which is separately fabricated from frame 102. It goes without saying that, in this case also, first holder 110 may be integrally molded with frame 102.

Further, though first holder 110 is integrally formed with frame 102, the present invention is not limited thereto. For example, coupling portion 114 may be integrally formed with frame 102, while first holder 110 is fabricated separately from coupling portion 114. In this case, first holder 110 is embedded in coupling portion 114 so as to protrude from coupling portion 114. Alternatively, coupling portion 114 and first holder 110 may be integrally fabricated. In this case, coupling portion 114 is embedded in frame 102. Similarly, second holder 203 may also be formed integrally with frame 102, or fabricated separately from frame 102 and attached to frame 102.

Figure 18:
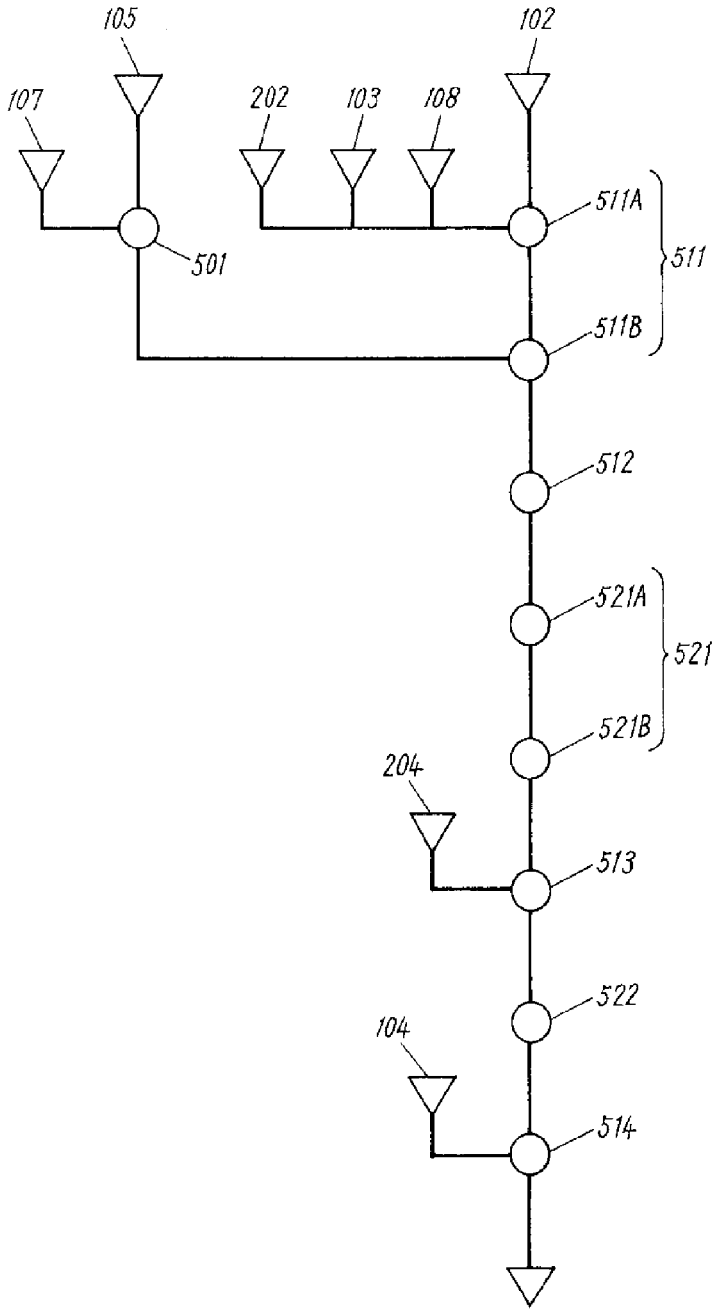
FIG. 18 is a flowchart of manufacturing the loudspeakers according to the exemplary embodiment of the present invention.

Next, a description will be given of a method for manufacturing loudspeaker 101 and loudspeaker 201 according to the exemplary embodiment of the present invention. FIG. 18 shows a flowchart of manufacturing the loudspeakers according to the exemplary embodiment of the present invention. The manufacturing process of loudspeaker 101 and loudspeaker 201 includes connecting step 501, mounting step 511, temporary fixing step 512, connecting step 513, and bonding step 514.

In connecting step 501, ends of lead wires 107 are connected to voice coil 105. Voice coil 105 and lead wires 107 are connected by connection member 204. Connection member 204 may be solder.

In mounting step 511, terminals 108, voice coil 105, magnetic circuit 103 and the like are mounted on frame 102. Therefore, mounting step 511 preferably comprises first mounting step 511A and second mounting step 511B. In first mounting step 511A, magnetic circuit 103 and terminals 108 are mounted on frame 102. In this step, magnetic circuit 103 is fixed to magnetic circuit attaching portion 102A shown in FIG. 6 by an adhesive agent. Fixing of magnetic circuit 103 and frame 102 is not limited to this manner, and a method such as swaging can be employed. Further, in this step, terminals 108 are inserted into hole 106D shown in FIG. 7.

In second mounting step 511B, voice coil 105 is mounted on frame 102 such that the tip of voice coil 105 to which lead wires 107 are previously connected by connection member 204 is positioned substantially at the center of magnetic circuit 103.

In temporary fixing step 512, lead wires 107 are held between terminals 108 and first holder 110 in a clamped state, and lead wires 107 are temporarily fixed to a predetermined position.

In connecting step 513, after temporary fixing step 512, lead wires 107 and terminals 108 are connected by connection member 204. Connection member 204 is preferably solder. Then, in bonding step 514, diaphragm 104 is bonded to voice coil 105 and frame 102, and loudspeaker 101 or loudspeaker 201 is completed.

Since loudspeaker 101 or loudspeaker 201 is manufactured through the steps described above, the connection work in connecting step 513 is easily performed. Accordingly, the connection work in connecting step 513 can be automated by mechanization. As a result, the number of steps of the connection work in connecting step 513 can be reduced, and hence an inexpensive loudspeaker 101 or loudspeaker 201 can be finished.

In a method for manufacturing loudspeaker 201, the following steps are added to or changed from the above manufacturing method. In the following, a description will be given focusing on the added step or the changed step.

In temporary fixing step 512, by pushing lead wire 107 toward terminal 108, at least one of first holding claw 111 and second holding claw 112 shown in FIG. 9A is elastically deformed, and lead wire 107 is inserted between terminal 108 and first holder 110. That is, lead wire 107 is inserted from slit 113 which is a lead insertion port. As lead wire 107 is inserted, first resilient portion 111A or second resilient portion 112A elastically deforms. When insertion of lead wire 107 to a predetermined position has completed, lead wire 107 is held and clamped by clamping portion 108C, first clamping portion 111B, and second clamping portion 112B. In this state, corner portion 111C and corner portion 112C abut on lead wire 107. In this case, in first mounting step 511A, damper 202 is also mounted on frame 102.

In holding step 521, lead wire 107 is held by second holder 203. Though holding step 521 is provided after temporary fixing step 512, the present invention is not limited thereto. For example, holding step 521 may be included in temporary fixing step 512, and can be simultaneously performed with the temporary fixing work. Alternatively, holding step 521 may be provided between connecting step 513 and bonding step 514.

Further, holding step 521 preferably includes attaching step 521A and hooking step 521B. In attaching step 521A, along second guide portion 203B, lead wire 107 is arranged at a predetermined position of second holder 203. Then, in hooking step 521B, after attaching step 521A, lead wire 107 is hooked on restricting claw 203A, and lead wire 107 is held by restricting claw 203A. Though attaching step 521A is provided after temporary fixing step 512, the present invention is not limited thereto. For example, solely attaching step 521A may be included in temporary fixing step 512, and simultaneously performed with the temporary fixing work. Further, hooking step 521B may be provided between connecting step 513 and bonding step 514.

In shaping step 522, after connecting step 513, lead wire 107 is shaped. To this end, in shaping step 522, a restricting jig (not shown) is inserted below lead wire 107 between voice coil 105 and second holder 203 (between lead wire 107 and damper 202). This restricting jig restricts the route of lead wire 107 between voice coil 105 and second holder 203.

In shaping step 522, after completion of insertion of the restricting jig, adjuster 107B is pushed downward. Thus, at adjuster 107B, lead wire 107 is shaped so as to be curved in the direction away from diaphragm 104. Since shaping step 522 is performed after connecting step 513, lead wire 107 is fixed to terminal 108. Accordingly, by adjuster 107B being pushed down, lead wire 107 is pulled. Then, lead wire 107 between voice coil 105 and second holder 203 abuts on the restricting jig.

By the constitution described above, lead wire 107 between voice coil 105 and second holder 203 can be easily shaped into a desired shape, by pushing down of adjuster 107B. Further, by the restricting jig, the route of lead wire 107 and the extent of slack between voice coil 105 and second holder 203 can be precisely restricted. Accordingly, the positional variations in the route of lead wire 107 between voice coil 105 and second holder 203 can be easily reduced. As a result, it becomes possible to suppress occurrence of trouble that lead wire 107 hits diaphragm 104 or damper 202 when voice coil 105 vibrates. Accordingly, noise produced by lead wire 107 hitting diaphragm 104 or damper 202 can be prevented. Shaping step 522 should be provided between holding step 521 and bonding step 514, and may be provided, for example, before connecting step 513.

Further, in temporary fixing step 512, lead wire 107 may be crushed by pushing lead wire 107 toward terminal 108 (in the arrow direction shown in FIG. 9B). By this constitution, lead wire 107 is shaped such that the width in the lateral width direction becomes lager than the thickness in the vertical direction of lead wire 107. As a result, lead wire 107 can be further firmly held by first holder 110. When a tinsel wire is used as lead wire 107, since the conducting wire of the tinsel wire can be easily deformed, lead wire 107 can be easily crushed.

In this case, the apex portions of lead wire 107 in the lateral width direction are preferably abutted on abutting wall 111E or abutting wall 112E. By this structure, lead wire 107 can be further firmly held by first holder 110.

INDUSTRIAL APPLICABILITY

According to the loudspeaker of the present invention and the method for manufacturing the loudspeaker, the effect of suppressing occurrence of noise generation attributed to a lead wire hitting a diaphragm or the like is obtained. Thus, they are useful to be applied to loudspeakers in wide variety of devices such as audio visual devices, automotive devices and the like.

REFERENCE MARKS IN THE DRAWINGS

101: loudspeaker
102: frame
102A: magnetic circuit attaching portion
102B: outer frame portion
102C: coupling portion
103: magnetic circuit
103A: magnet
103B: lower plate
103C: upper plate
103D: center pole
104: diaphragm
105: voice coil

106: connector portion
106A: housing portion
106B: sidewall
106C: bottom surface
106D: hole
107: lead wire
107A: connection portion
107B: adjuster
107C: clamping portion
107D: first apex portion
107E: second apex portion
108: terminal
108A: contact portion
108B: insert portion
108C: clamping portion
108D: connection portion
108E: lead wire restriction portion
109: magnetic gap
110: first holder
110A: first guide portion
111: first holding claw
111A: first resilient portion
111B: first clamping portion
111C: corner portion
111D: first inclined surface
111E: abutting wall
112: second holding claw
112A: second resilient portion
112B: second clamping portion
112C: corner portion
112D: first inclined surface
112E: abutting wall
113: slit
114: coupling portion
114A: recess portion
120: first holder
201: loudspeaker
202: damper
203: second holder
203A: restricting claw
203B: second guide portion
204: connection member
501: connecting step
511: mounting step
511A: first mounting step
511B: second mounting step
512: temporary fixing step
513: connecting step
514: bonding step
521: holding step
521A: attaching step
521B: hooking step

The invention claimed is:

1. A loudspeaker comprising:

a frame;

a magnetic circuit disposed at a central part of the frame, the magnetic circuit being provided with a magnetic gap;

a diaphragm coupled to an outer circumference of the frame;

a voice coil provided at a central part of the diaphragm, the voice coil being inserted into the magnetic gap;

a connector portion having a conductive terminal, the connector portion being provided to the frame near the outer circumference; and a lead wire having a connection portion connected to the conductive terminal, the lead wire connecting the conductive terminal and the voice coil together, wherein the connector portion has a first holder holding the lead wire, the lead wire includes a clamping portion held and clamped between the conductive terminal and the first holder, and the first holder includes:

a first holding claw;

a second holding claw formed next to the first holding claw; and a coupling portion coupling the first holding claw and the second holding claw together, and wherein a slit is provided between the second holding claw and the first holding claw, the lead wire is disposed in the slit, a clearance between the first holding claw and the second holding claw in the slit is smaller than a diameter of the lead wire, and the lead wire is clamped to the conductive terminal by an elastic force of at least one of the first holding claw and the second holding claw.

2. The loudspeaker according to claim 1, wherein the lead wire is held and clamped by: an end of the first holding claw nearer to the conductive terminal and provided at a side surface of the first holding claw facing the slit; an end of the second holding claw nearer to the conductive terminal at a side surface of the second holding claw facing the slit; and the conductive terminal.

3. The loudspeaker according to claim 2, wherein the first holder is provided with a first guide portion that guides the lead wire to a predetermined position, the first guide portion is provided at least at one of the side surface of the first holding claw facing the slit, and the side surface of the second holding claw facing the slit, and the slit between the first holding claw and the second holding claw tapers along a direction to the lead wire guided.

4. The loudspeaker according to claim 1, wherein a width of an end of the slit nearer to the voice coil is different from a width of an end of the slit nearer to the outer circumference.

5. The loudspeaker according to claim 1, wherein a first inclined surface inclined relative to a direction in which the lead wire extends is formed on at least one of the side surface of the first holding claw facing the slit and the side surface of the second holding claw facing the slit.

6. The loudspeaker according to claim 1, wherein the first holding claw and the second holding claw extend from the coupling portion to a center of the frame, and a width of an end of the slit nearer to the coupling portion is greater than a width of an end of the slit farther from the coupling portion.

7. The loudspeaker according to claim 1, wherein the first holding claw and the second holding claw extend from the coupling portion toward the center of the frame, and a width of an end of the slit being nearer to the coupling portion is smaller than a width of an end of the slit being farther from the coupling portion.

8. The loudspeaker according to claim 1, wherein the lead wire is a tinsel wire including a core and a conductor portion provided at an outer circumference of the core, and the conductor portion is held as being compression-deformed by an elastic force of one of the first holding claw and the second holding claw.

9. The loudspeaker according to claim 1, wherein in a cross section of the clamping portion of the lead wire, a dimension along a first direction in which the first holding claw and the second holding claw are disposed next to each other is greater than a dimension along a second direction being perpendicular to the first direction.

10. The loudspeaker according to claim 9, wherein walls that face the slit are formed at the first holding claw and the second holding claw, respectively, in the clamping portion, the lead wire includes a first apex portion nearer to the first holding claw in the first direction and a second apex portion nearer to the second holding claw in the first direction, and at least one of a state where the wall of the first holding claw abuts on the first apex portion and a state where the wall of the second holding claw abuts on the second apex portion is established.

11. The loudspeaker according to claim 1, wherein a second holder holding the lead wire is further provided between the voice coil and the first holder.

12. The loudspeaker according to claim 11, wherein the lead wire curves toward the diaphragm between the voice coil and the second holder, and curves away from the diaphragm between the second holder and the first holder.

13. The loudspeaker according to claim 11, wherein the second holder includes a restricting claw that restricts the lead wire to a predetermined position, and a second guide portion that guides the lead wire to the predetermined position.

14. A loudspeaker comprising:

a frame;

a magnetic circuit disposed at a central part of the frame, the magnetic circuit being provided with a magnetic gap;

a diaphragm coupled to an outer circumference of the frame;

a voice coil provided at a central part of the diaphragm, the voice coil being inserted into the magnetic gap;

a connector portion having a conductive terminal, the connector portion being provided to the frame near the outer circumference; and a lead wire having a connection portion connected to the conductive terminal, the lead wire connecting the conductive terminal and the voice coil together, wherein the connector portion has a first holder holding the lead wire, wherein the lead wire includes a clamping portion held and clamped between the conductive terminal and the first holder, wherein a second holder holding the lead wire is further provided between the voice coil and the first holder, and wherein the second holder includes a restricting claw that restricts the lead wire to a predetermined position, and a second guide portion that guides the lead wire to the predetermined position.

* * * * *